US006367735B1

(12) United States Patent
Folsom et al.

(10) Patent No.: US 6,367,735 B1
(45) Date of Patent: Apr. 9, 2002

(54) PROJECTILE DIVERTER

(75) Inventors: Mark Folsom, Carmel; Charles Piper, III, Los Banos; Wm. David Fahey, Cupertino; Jared M. McGowan, Boulder Creek, all of CA (US)

(73) Assignee: Quantic Industries, Inc., San Carlos, CA (US)

( * ) Notice: Subject to any disclaimer, the term of this patent is extended or adjusted under 35 U.S.C. 154(b) by 0 days.

(21) Appl. No.: 09/502,119

(22) Filed: Feb. 10, 2000

(51) Int. Cl.[7] ..... F41G 7/00

(52) U.S. Cl. ..... 244/3.22; 244/3.21; 102/501

(58) Field of Search ..... 244/3.1–3.14, 244/3.24–3.3, 3.22; 89/1.2, 1.8, 27.11, 28.05, 28.1, 30, 31, 1.11; 102/473, 479, 501, 513, 530

(56) References Cited

U.S. PATENT DOCUMENTS 2,958,282 A * 11/1960 Czajkowski et al. ..... 244/3.14
3,018,981 A * 1/1962 Weller ..... 244/3.14
3,028,807 A * 4/1962 Burton et al. ..... 244/3.13
3,360,214 A * 12/1967 Stcherbatcheff ..... 244/3.14
3,374,967 A * 3/1968 Plumley ..... 244/3.14
4,573,648 A * 3/1986 Morenus et al. ..... 244/3.22
4,685,639 A * 8/1987 Bains ..... 244/3.22

FOREIGN PATENT DOCUMENTS

EP 0439392 A1 * 7/1991 ..... F41G/7/22

* cited by examiner

*Primary Examiner*—Bernarr E. Gregory
(74) *Attorney, Agent, or Firm*—Robert Moll

(57) ABSTRACT

The present invention provides a fast, low-cost, small diverter capable of generating a relatively high impulse (1–5 N-sec) over a short time period. The diverter is adapted for installation in a projectile for steering the projectile in flight by ejecting an end cap in response to control signals from a guidance system. In one embodiment, multiple diverters are arranged in one or more bands about a flying projectile such as a rocket. Each diverter includes a header assembly providing a mounting surface and support for a plurality of electrical leads, a reactive semiconductor bridge mounted on the mounting surface of the header assembly and providing an electrical path for the electrical leads at a certain voltage across the bridge, a diverter body supporting the header assembly and containing a prime, wherein the reactive semiconductor bridge and the prime define a gap, and an end cap attached to the diverter body and containing a propellant.

3 Claims, 5 Drawing Sheets

VIEW B

DETAIL A

PROJECTILE DIVERTER

The present invention relates to controlling the flight path of rockets, missiles, and other flying projectiles. In particular, the invention relates to a small fast diverter for use with a projectile for steering the projectile in flight by ejecting an end cap of the diverter in response to a signal from a guidance system.

BACKGROUND OF THE INVENTION

In general, a diverter generates lateral reaction force to steer a rocket, missile, and other projectile in flight. The amount of impulse generated by the diverter will determine how much the flight path is diverted. Impulse is the product of the average reaction force over the time exerted. Recent applications for diverters include steering 2.75-inch diameter rockets, artillery, and gun projectiles, e.g., 30 mm projectiles. In such applications, we need small diverters that can generate relative high impulse (e.g., 1 to 5 N-sec) in short time periods. Because rockets, missiles, and projectiles often spin at high rates, the impulses must be made in a short time period, e.g., on the order of 1 ms. If, for example, a projectile is spinning at 3600 RPM, it is spinning at 60 revolutions per second or 21.6 degrees per millisecond. If the diverter provides a reaction force for 10 ms, this will provide force over 216 degrees. Providing the force over this time period is not efficient. Instead, we would like to provide the force for 1-ms or less. If the diverter can provide the force over this shorter period, the guidance system can make multiple steering corrections when needed as a projectile flies through space by igniting the multiple diverters arranged around it.

One might consider using small rocket motors for diverters having small volume, but this has proven ineffective when a relatively high impulse is required over a short time. It is too difficult for a rocket motor with loose loaded propellant to burn all of its propellant in a short time without ejecting a large percentage of the propellant unburned. Further, the relatively low packing density of propellant results in the rocket motor ejecting a considerable volume of propellant. Additionally, the rocket propellant container cannot be manufactured that small. Providing the propellant in a higher density form, e.g., cast propellant grain, might appear helpful, but a compact single grain is unlikely to have a thin enough web to operate in the required time period due to propellant burn rate limitations. Where low cost is required, such as less than $5.00 per diverter, without large capital investment, it is difficult to envision good results with rocket motors. Small rocket motors can provide impulses of 1–5 N-sec, but for longer time periods on the order of 10 ms. Additionally, rocket motors are not volume efficient for another reason. To fully use the energy in a rocket propellant, a converging/diverging nozzle with significant mass and volume is needed to fully expand and accelerate the propellant gas.

Another approach might be to use conventional bridgewire pyrotechnic devices for small diverters, but there are unsolved problems. One problem is how to ignite them quickly and reliably. Conventional semiconductor bridge technology provides very fast hot ignition, but it is also only low energy ignition lasting for microseconds. The energy output is dependent on energy input; when only low input energy is available, only small output energy can be produced, which may not be sufficient to provide reliable ignition. Further, conventional pyrotechnic devices and semiconductor bridges require tight coupling between the ignition element and the pyrotechnic material. Up to now it has been critical for reliable ignition with semiconductor bridges that the ordnance or pyrotechnic material to be ignited be in close contact with the semiconductor bridge during ignition. This means lower ignition energy can be used, but it requires intimate contact between the bridge and prime, adding to manufacturing costs. The applications mentioned earlier can subject diverters to very high accelerations and shocks, e.g., on the order of 100,000 g's. During such events the prime may separate from the ignition element and reduce the reliability of the diverter. Bridgewires require high firing energies or very small and unsafe bridgewires for fast response. Thus, attempts to produce small low cost diverters generating relatively high impulse over brief periods of time have not been successful.

SUMMARY OF THE INVENTION

The present invention provides a small, fast, low cost diverter for steering a rocket, missile, or other projectile. The diverter uses a reactive semiconductor bridge for the ignition source and ejects an end cap from a diverter body to generate a fast relatively high impulse. A header assembly extends into the diverter body and supports the reactive semiconductor bridge and provides electrical contact to a fireset. When desired, the reactive semiconductor bridge provides fast ignition of the prime and allows for a gap between the semiconductor bridge and the prime. The ignited prime in turn ignites the propellant. The burning propellant produces gases, which are confined in the diverter until the pressure builds to the point when the end cap of the diverter is ejected. Requiring the propellant to generate high pressures to eject a solid mass such as an end cap is a much more efficient method of retrieving the energy from the propellant than ejecting hot gases from a rocket motor. The advantage of the present invention is a relatively low cost, high impulse compact, fast functioning diverter results compared to what can be provided with a small rocket motor. The use of the reactive semiconductor bridge allows very fast firings since ignition occurs in microseconds. The reactive semiconductor bridge allows reliable operation at low input energies since the reactive semiconductor bridge provides a large energy output to ignite the prime. The reactive semiconductor bridge can ignite prime across a gap and this provides a safety margin in case the shock or acceleration of projectile launch would cause the prime to become separated from the bridge. Reliable diverters can be therefore built at relatively low cost using this technology.

DETAILED DESCRIPTION OF THE PREFERRED EMBODIMENTS

Figure 1:
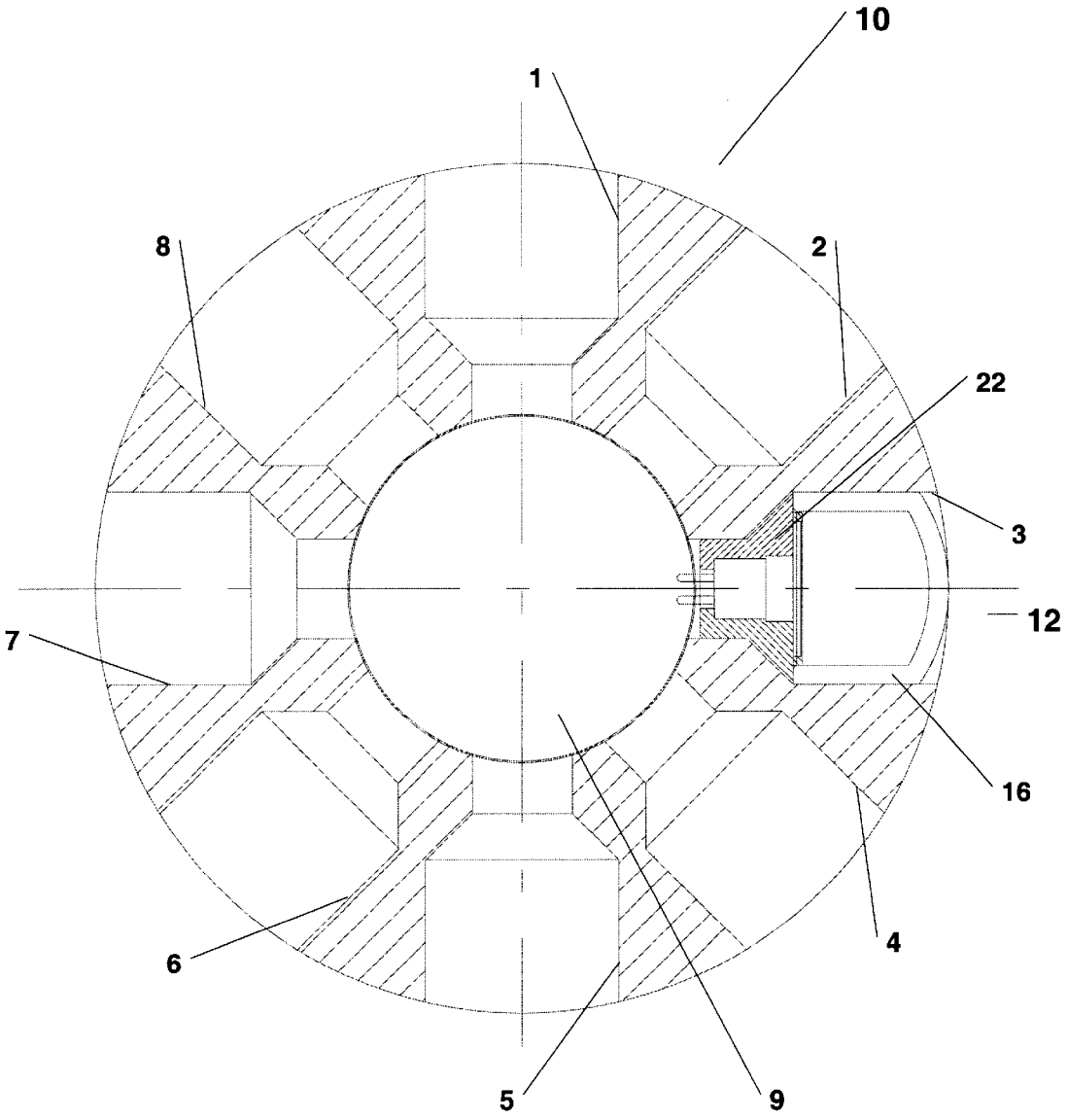
FIG. 1 illustrates a cross-sectional view of a rocket with a single diverter installed on the right hand side.

FIG. 1 shows a cross-sectional view of a rocket 10 with a single diverter 12 on the right side. In this embodiment, the rocket 10 is a 2.75-inch diameter rocket. It should be apparent from the specification, however, that the diverter would be useful on many types of projectiles. As shown in FIG. 1, the core of rocket 10 has eight barrels 1, 2, 3, 4, 5, 6, 7, and 8 for installing eight diverters, just like diverter 12, in a band about the rocket 10. The rocket 10 includes a free passage 9 to allow connection of each of the diverters 12 to the fireset (not shown).

Figure 2:
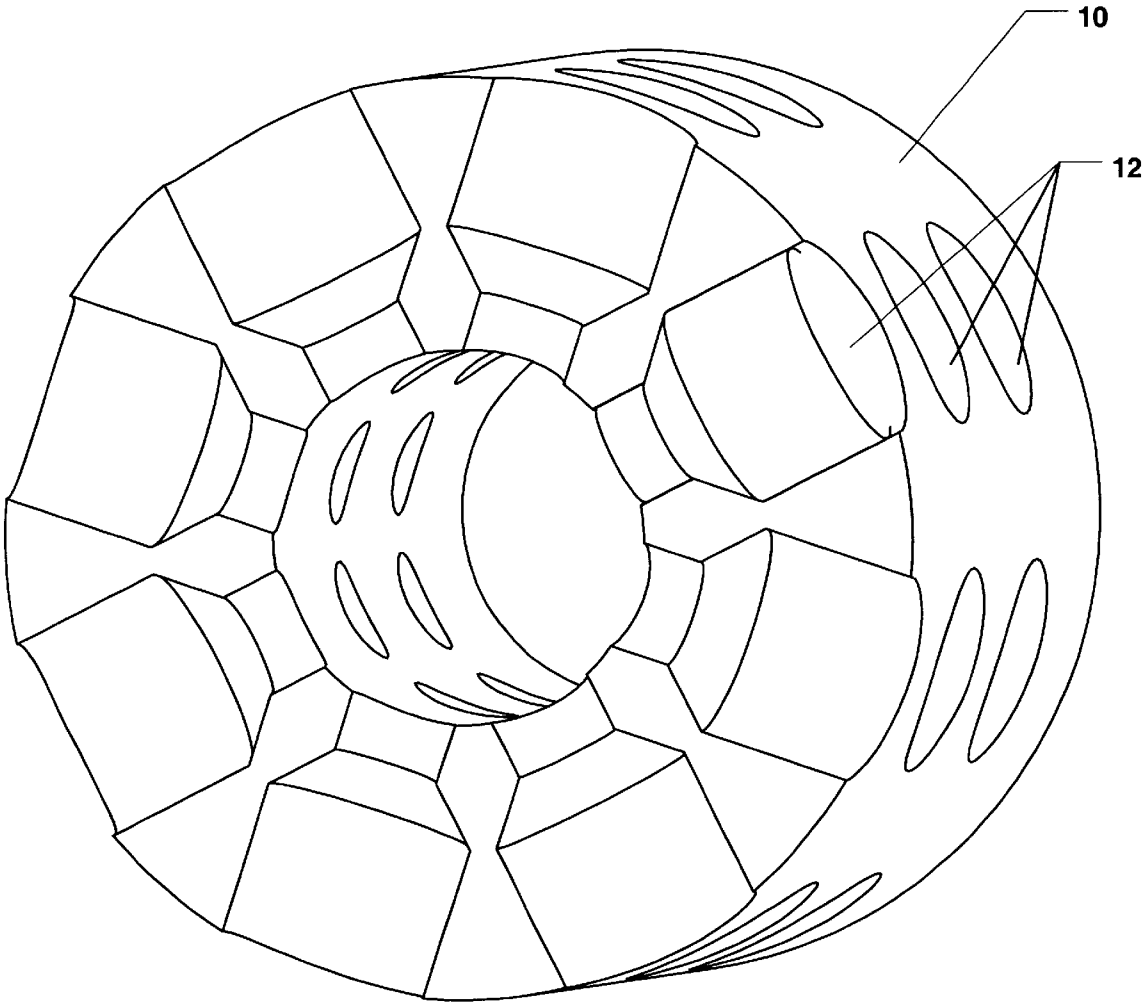
FIG. 2 illustrates a perspective view of the rocket with three bands of diverters. Each band includes eight diverters like those shown in FIGS. 1 and 3B. The view includes a partial cross-section through the first of the three bands of diverters.

The diverters can be arranged in several bands about the rocket 10 as shown in FIG. 2. FIG. 2 illustrates a perspective view of the rocket 10 with three bands of diverters 12. Each band includes eight diverters but other amounts are possible besides those shown in FIGS. 1–2. FIG. 2 shows a partial cross-section through the first of three bands of diverters.

As shown in FIGS. 1–2, the diverters have axes perpendicular to the axis of rocket 10, such that the ejection of an end cap 16 from a diverter body 22 will produce a lateral reaction force. It may be desirable to have from 1 to 64 diverters on the rocket 10. It is preferred that the diverter axes be perpendicular to the rocket axis and arranged at equal angles apart to simplify guidance system calculations.

Figure 3B:
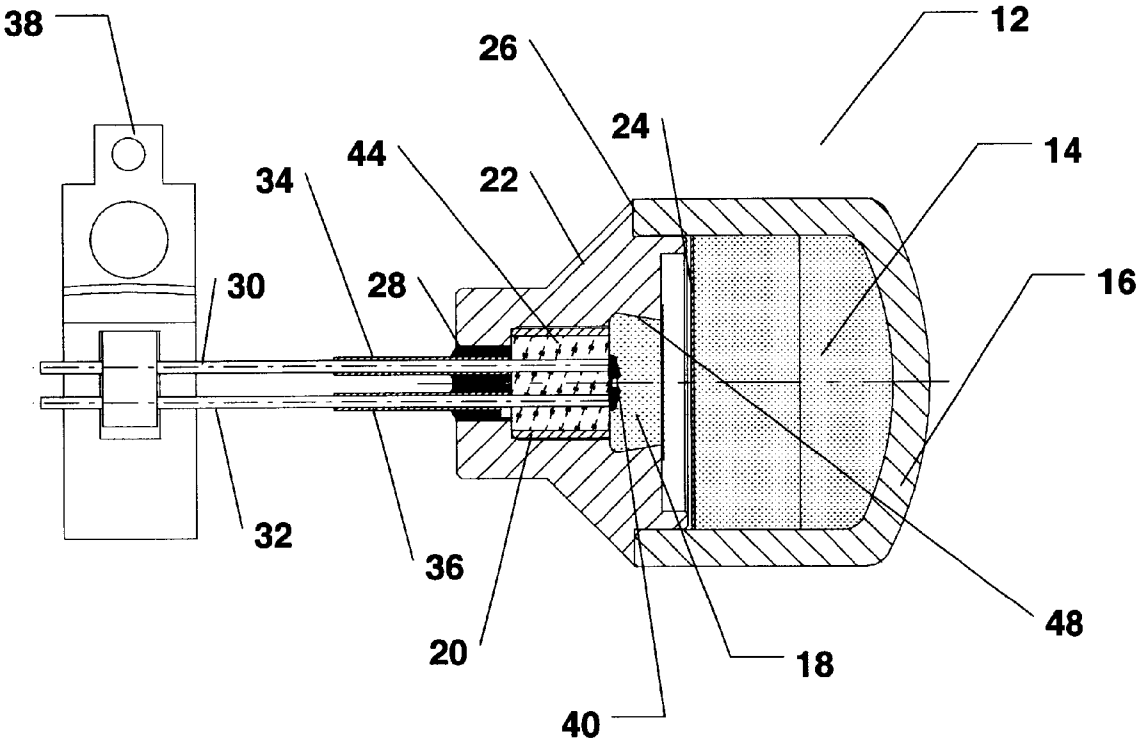
FIG. 3B is a detailed cross-section of the diverter shown in FIG. 1.

FIG. 3B shows additional details of the diverter 12 shown in FIG. 1. As shown in FIG. 3B, the diverter 12 includes an end cap 16, made of strong steel, preferably of 17-4 PH CRES, condition H-1025, with a clean passivated finish. The end cap 16 is attached to the diverter body 22, and made of the same material and finish as the end cap 16. A conventional adhesive bonding material 26, such as a cyano acrylate adhesive, a suitable conventional structural epoxy, or a conventional urethane adhesive, is applied on the contacting surfaces between the end cap 16 and the diverter body 22 to bond the end cap 16 to the diverter body 22 until the time that the end cap 16 is ejected. One of ordinary skill would also understand that the end cap 16 and the diverter body 22 could be also attached by other techniques such as crimping. The end cap 16 is filled with a loosely loaded propellant 14, preferably 50 wt. % Bullseye (pistol powder) and 50 wt. % HMX (an explosive ordnance material), shotgun powder or the like. In an optional feature, the invention provides a conventional adhesive backed paper closure, which acts as a thermal closure 24, to seal and hold the propellant 14 in place for handling during assembly of the diverter 12.

Figure 3A:
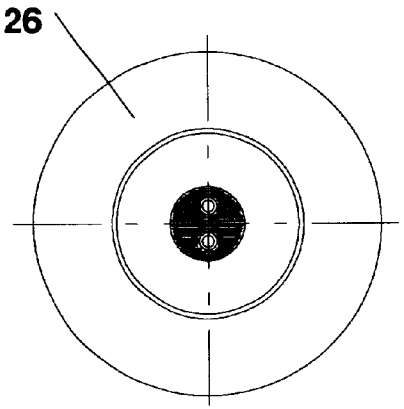
FIG. 3A is an end view of the diverter shown in FIG. 1.

The diverter body 22 contains the prime 18, preferably zirconium potassium perchlorate, or a similar ordnance material. The diverter body 22 has an aperture for housing the header assembly 20. The header assembly 20 includes a glass substrate 44 from which two electrical leads 30 and 32 protrude to provide electrical contact from a fireset (not shown) to a reactive semiconductor bridge 40 mounted on the other end of the header assembly 20. Electrical leads 30 and 32 are made of stainless steel or KOVAR. Conventional shrink tubing 34 and 36 insulates the electrical leads 30 and 32 from contacting and shorting to the diverter body 22. Conventional potting material 28 retains the shrink tubing 34 and 36 and fills the gap between the shrink tubing 34 and 36 and the diverter body 22. A conventional shunt 38 provides an electrical short when attached to the electrical leads 30 and 32 for safe handling of the diverter 12, and which shunt is removed when the diverter 12 is attached to the fireset. FIG. 3A is an electrical lead end view of the diverter 12 shown in FIG. 3B.

Figures 4A, 4B, 4C:
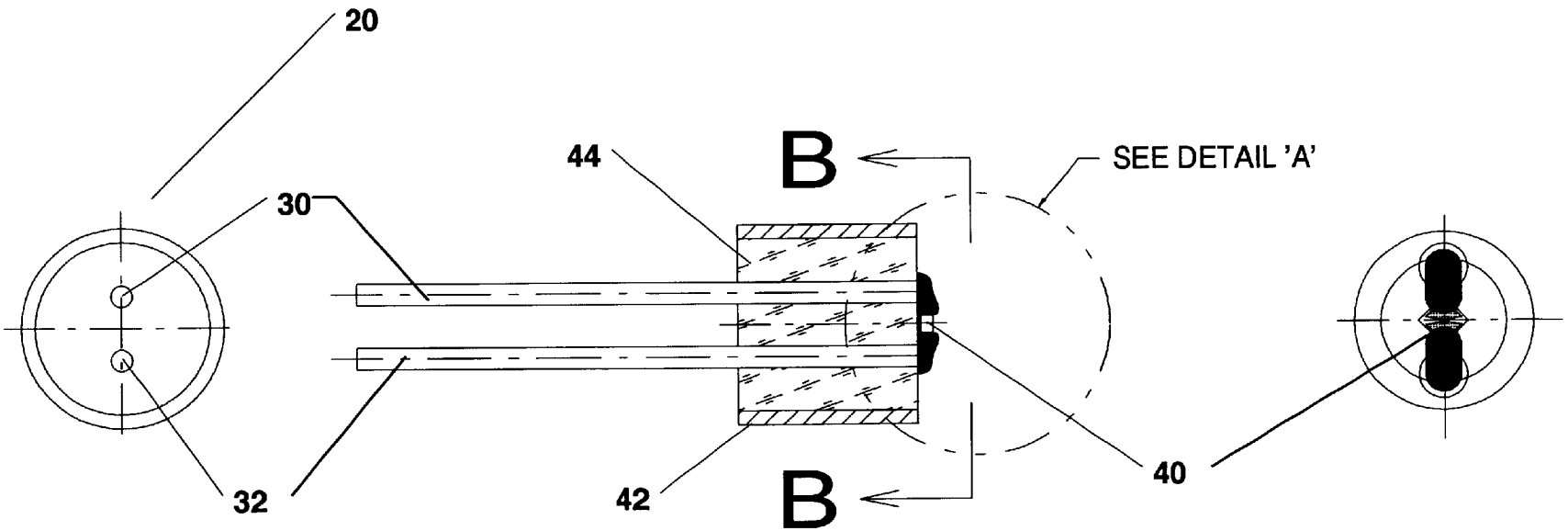
FIG. 4A is an electrical lead end view of the header assembly shown in FIG. 4B.
FIG. 4B is a cross-section of the header assembly shown in FIG. 3B.
FIG. 4C is a semiconductor bridge end view of the header assembly shown in FIG. 4B.

FIG. 4A shows the end of header assembly 20 from which electrical leads 30 and 32 protrude. FIG. 4B shows a cross-section through the header assembly 20, including the glass substrate 44, the stainless steel sleeve or eyelet 42, and the electrical leads 30 and 32, and also through the semiconductor bridge 40. FIG. 4B includes detail A shown as FIG. 5A, and a view B—B shown as FIG. 5B. FIG. 4C shows the end of the header assembly 20 on which the semiconductor bridge 40 is mounted.

Figure 5B:
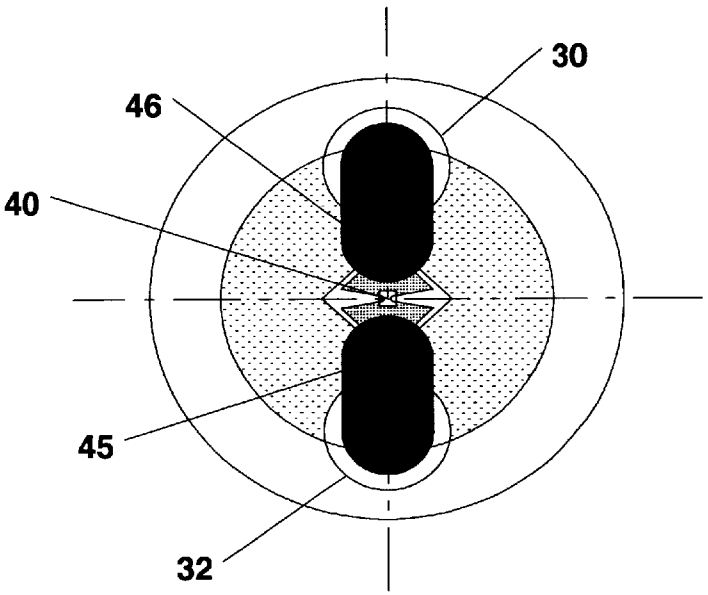
FIG. 5B is a view of the semiconductor bridge mounted on the header assembly shown in FIGS. 3B and 4C.
Figure 5A:
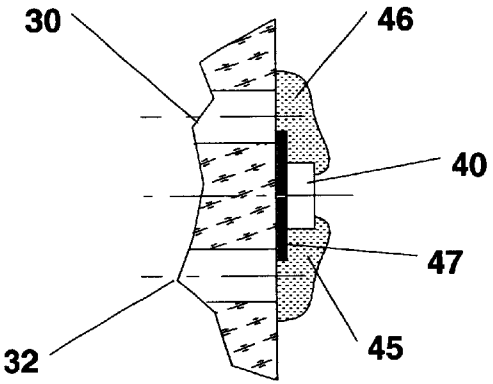
FIG. 5A is a detailed cross-section of the semiconductor bridge shown in FIG. 3B.

FIG. 5A is a close up and a cross-section of the semiconductor bridge 40 mounted on the header assembly 20, labeled detail A in FIG. 4B. FIG. 5B is an end view. The reactive semiconductor bridge 40 is shown as mechanically attached on the header assembly 20 by a non-conductive epoxy 47 such as Able Bond 84-3. Electrical leads 30 and 32 provide an electrical contact point on the header assembly 20. Electrically conductive epoxy 46 and 45 such as Able Bond 84-1 electrically connect each of the contact pads of the semiconductor bridge 40 to the electrical leads 30 and 32.

In operation, the reactive semiconductor bridge 40 provides fast ignition of the prime 18 even when there is a gap between the semiconductor bridge 40 and the prime 18. A suitable reactive semiconductor bridge 40 is described in U.S. Pat. Nos. 5,847,307 and 5,905,226, which patents are hereby incorporated by reference.

After the semiconductor bridge 40 is triggered based on electrical signals from the fireset, hot plasma forms, igniting the prime 18, which in turn ignites the propellant 14. Burning propellant 14 produces gases, which are confined in the diverter 12 until the pressure builds to the point where the end 16 is ejected. Ejecting the end cap 16 is more efficient than generating an impulse by rocket propellant. The ability of the reactive semiconductor bridge 40 to ignite the prime 18 across the gap provides a margin of safety in case the shock or acceleration of the launch causes the prime 18 to separate from the semiconductor bridge 40. Diverters 12 can be built at low cost using this technology.

In a preferred embodiment, the diverter body 16 has an undercut 48 such that the mouth of the diverter body 22 is smaller than the base as shown in FIG. 3B to hold the prime 18 in place during high shock conditions and during ignition. When fired a semiconductor bridge 40 tends to throw off the prime 18 rather than ignite it unless the prime 18 is retained. The undercut 48 retains the prime 18 in place during firing. The reactive semiconductor bridge 40 allows a gap between the semiconductor bridge 40 and the prime 18. It should be noted that the reactive semiconductor bridge 40 ignites the prime 18 across a gap, but not necessarily if the prime 18 is allowed to dynamically shift away from the semiconductor bridge 40 during the firing process.

Methods of the present invention provide the following steps: a firing signal from the fireset is transmitted to the electrical leads 30 and 32 of the diverter 12 when the shunt 38 removed. The voltage level of fire signal required depends upon the type of the semiconductor bridge 40 mounted on the header assembly 20. The firing signal can be supplied by many methods including applying one of the following:

1) A constant current of 1 to 10 amps for less than 1 ms. The actual current will depends on the sensitivity and type of semiconductor bridge used.

2) A capacitive discharge of, e.g., approximately 25 volts from a 40-microfarad capacitor would be typical for driving a semiconductor bridge, but values down to 3 volts and capacitor values down to less than 1 microfarad are possible when highly sensitive semiconductor bridges are used. Higher voltages, voltages up and greater than 500 volts can be used with junction semiconductor bridges that have DC blocking.

3) A voltage signal whose value depends on the semiconductor bridge type, properties, and characteristics.

The firing signal causes the semiconductor bridge 40 to generate hot plasma (>2000 F.) that ignites the prime 18. The prime 18 is designed to ignite promptly when driven by the semiconductor bridge 40 and generate in less than 100 microseconds hot particles and heat. The hot particles and heat from the ignited prime ignite the propellant 14. The propellant 14 is designed to rapidly burn resulting in a rapid pressure rise in the volume confined by the end cap 16 and diverter body 22. Each diverter 12 is contained within a barrel as shown in FIGS. 1–2. The electrical lead end of the barrel is closed to match the taper at the back of the diverter 12. The taper is provided on the diverter 12 so the diverters can be placed close together. A slot, not shown, is cut in the side of the back of the barrel to allow the electrical wires to exit and make connection to the fireset. The opposite end of the barrel is open as shown in FIGS. 1–2. As the pressure builds inside the diverter 12 produced by the burning of the prime 18 and the propellant 14, the end cap 16 outer diameter swells and seals against the inner diameter of the barrel defined by the rocket 10. Also the pressure forces the diverter body 22 back against the taper sealing this potential exit path for hot gas. The header assembly 20 is mounted on the diverter body 22. As the pressure within the diverter 12 continues to increase from the burning of prime 18 and propellant 14, the force on the end cap 16 reaches a point where the end cap 16 separates from the diverter body 22 and is accelerated down the barrel and ejected. Ejecting the end cap 16 results in a reaction force, that is, the diverting force. Additionally, diverting force is created by the reactive forces from the ejection of the hot gases from the burning of the prime 18 and the propellant 14 out of the barrel similar to the operation of a rocket.

What is claimed:

1. A projectile diverter, comprising:

a header assembly providing a mounting surface and support for a plurality of electrical leads;

a reactive semiconductor bridge mounted on the mounting surface of the header assembly and providing an electrical path for the electrical leads at a certain voltage across the bridge;

a diverter body supporting the header assembly and containing a prime, wherein the reactive semiconductor bridge ignites the prime; and an end cap attached to the diverter body and containing a propellant, wherein the rapid burning of the propellant produces gases, which eject the end cap from the diverter body to produce a force to divert the flying projectile.

2. A diverter for use with a projectile for steering the projectile in flight by ejecting a end cap of the diverter in response to a signal from a guidance system, comprising:

a header assembly with two electrical leads;

a reactive semiconductor bridge providing an electrical path from one electrical lead to the other electrical lead when a thresh hold voltage is applied across the electrical leads;

a prime;

a diverter body supporting the header assembly and containing the prime, wherein the reactive semiconductor bridge ignites the prime; and an end cap attached to the diverter body and containing a propellant producing gases, which eject the end cap from the diverter body to produce a force to divert the flying projectile.

3. A projectile with a plurality of diverters for diverting the flight path of the projectile, comprising:

a projectile;

a plurality of diverters arranged in a band about the projectile, wherein each diverter includes:

a header assembly providing a mounting surface and support for a plurality of electrical leads;

a reactive semiconductor bridge mounted on the mounting surface of the header assembly and providing an electrical path for the electrical leads at a certain voltage across the bridge;

a prime;

a diverter body supporting the header assembly and containing the prime, wherein the reactive semiconductor bridge ignites the prime; and an end cap attached to the diverter body and containing a propellant, wherein th rapid burning of the propellant produces gases, which eject the end cap from the diverter body to produce a force to divert the flying projectile.

* * * * *